US005351490A

United States Patent [19]

Ohishi et al.

[11] Patent Number: 5,351,490

[45] Date of Patent: Oct. 4, 1994

[54] PISTON/DISPLACER SUPPORT MEANS FOR A CRYOGENIC REFRIGERATOR

[75] Inventors: Tatsuru Ohishi; Kazuki Niitsu; Hiroyuki Kiyota; Nobuo Fujii; Yoshihiro Katagishi; Takeshi Miyazawa, all of Kanagawa, Japan

[73] Assignee: Mitsubishi Denki Kabushiki Kaisha, Tokyo, Japan

[21] Appl. No.: 10,273

[22] Filed: Jan. 28, 1993

[30] Foreign Application Priority Data

| | | | |
|---|---|---|---|
| Jan. 31, 1992 | [JP] | Japan | 4-016105 |
| Feb. 15, 1992 | [JP] | Japan | 4-028671 |
| Jan. 13, 1993 | [JP] | Japan | 5-004135 |

[51] Int. Cl.[5] ..... F25B 9/14

[52] U.S. Cl. ..... 62/6; 60/520; 267/161

[58] Field of Search ..... 62/6; 60/520; 267/161, 267/162; 92/165 R

[56] References Cited

U.S. PATENT DOCUMENTS

| | | | |
|---|---|---|---|
| 2,348,225 | 5/1944 | Petty | 267/161 X |
| 2,690,529 | 9/1954 | Lindblad | 267/161 X |
| 3,344,397 | 9/1967 | Elliott et al. | 267/161 X |
| 4,397,155 | 8/1983 | Davey . | |
| 4,475,335 | 10/1984 | Davey . | |
| 4,541,429 | 9/1985 | Prosl et al. . | |
| 4,872,313 | 10/1989 | Kazumoto et al. . | |
| 5,088,288 | 2/1992 | Katagishi et al. . | |
| 5,113,662 | 5/1992 | Fujii et al. . | |
| 5,134,594 | 7/1992 | Woo | 267/161 X |

FOREIGN PATENT DOCUMENTS

| | | | |
|---|---|---|---|
| 97864 | 4/1924 | Austria | 267/161 |
| 0437678 | of 1990 | European Pat. Off. . | |
| 3621133 | of 1988 | Fed. Rep. of Germany . | |
| 0020958 | 2/1980 | Japan | 267/161 |

OTHER PUBLICATIONS

R. G. Ross, Jr., "Oxford Sterling Cooler Technical Overview", TIGER/ITER Briefing, Jet Prop. Lab, Oct. 10, 1989, 23 pages.

T. Baumeister, L. Marks, "Standard Handbook for Mechanical Engineers", 7th ed., 1967, pp. 5–8 and 5–9.

*Primary Examiner*—Henry A. Bennet
*Assistant Examiner*—Christopher Kilner
*Attorney, Agent, or Firm*—Wolf, Greenfield & Sacks

[57] ABSTRACT

A cryogenic refrigerator comprises a compressor including a compressor housing within which a cylinder is mounted, and a piston reciprocal within the cylinder, and a cold finger including a low temperature cylinder within which a displacer is reciprocable, and a regenerater mounted within the displacer. A plurality of flat piston suspension springs include a plurality of spiral slits to provide a plurality of spiral arms deflectable as the piston is reciprocated within the compressor cylinder. A plurality of annular inner retainers are secured to the piston and adapted to sandwich the inner peripheral edges of the piston suspension springs. A plurality of annular outer retainers are secured to the compressor housing and include a plurality of projections extending inwardly from the outer ends of the spiral slits to sandwich the outer peripheral edges of the flat piston suspension springs.

24 Claims, 12 Drawing Sheets

PISTON/DISPLACER SUPPORT MEANS FOR A CRYOGENIC REFRIGERATOR

BACKGROUND OF THE INVENTION

1. Field of the Invention

The present invention generally relates to a cryogenic refrigerator and more particularly, to means for supporting piston/displacer for use in such a cryogenic refrigerator.

2. Description of the Related Art

A conventional stirling refrigerator is designed, for example, to cool infrared sensors to as low as 77K and generally comprises a compressor, and a cold finger connected to the compressor through a conduit. The compressor includes a vertical cylinder fit within the upper end of a compressor housing, and a piston mounted for reciprocal motion within the cylinder. A plurality of flat piston suspension springs are horizontally disposed within the compressor housing to support the piston so as to prevent rubbing contact of the piston with the inner wall of the cylinder and thus, wear of the piston and the cylinder. Each of the piston suspension springs is in the form of a circular disk and includes a plurality of spiral slits to provide a plurality of spiral arms (see FIG. 16). The spiral arms are vertically deflected as the piston is reciprocated within the cylinder.

A plurality of annular outer retainers are secured to the inner wall of the housing and arranged to sandwich the outer peripheral edges of the piston suspension springs. Similarly, a plurality of annular inner retainers are secured to a piston rod and arranged to sandwich the inner peripheral edges of the piston suspension springs. In this arrangement, however, the spiral arms are susceptible to fatigue failure as a result of periodic application of local stresses during the normal operation of the compressor. This is due to the fact that the inner and outer ends of the spiral arms are held substantially in point contact with the circumferential edges of the inner and outer retainers (see FIG. 17) and subject to high stress concentration as the spiral arms are deflected.

The cold finger includes a low temperature cylinder within which a displacer is reciprocally moved. The displacer has a body and a rod extending downwardly from the body. The interior of the low temperature cylinder is divided by the displacer into two chambers, namely, a low temperature chamber above the displacer, and a high temperature chamber below the displacer body. A regenerator is mounted within the displacer body. A gas port is formed in the displacer body to provide a fluid communication between the low temperature chamber and the high temperature chamber via the regenerator. A first sleeve is fixed within the lower part of the low temperature cylinder to surround part of the displacer body. A second sleeve is fixed below the high temperature chamber. The displacer rod extends through the second sleeve and into a spring chamber. A plurality of flat displacer suspension springs (see FIG. 18) are mounted within the spring chamber to support tile displacer so as to prevent rubbing contact of the displacer with the first sleeve and the second sleeve and thus, wear of the displacer and the sleeves as the displacer is reciprocated. Each of the displacer suspension springs is in the form of a circular disk and has a plurality of spiral slits to provide a plurality of spiral arms. The spiral arms 30*a* are vertically deflected as the displacer is reciprocated.

A plurality of annular outer retainers are secured to the inner wall of the spring chamber to sandwich the outer peripheral edges of the displacer suspension springs. Similarly, a plurality of annular inner retainers are secured to the displacer rod to sandwich the inner peripheral edges of the displacer suspension springs. In this arrangement, however, the spiral arms are susceptible to fatigue failure as a result of periodic application of local stresses during the normal operation of the displacer. This is due to the fact that the inner and outer ends of tile spiral arms are held substantially in point contact with the circumferential edges of the inner and outer retainers (see FIG. 19) and subject to high stress concentration as the spiral arms are deflected.

SUMMARY OF THE INVENTION

It is an object of the present invention to provide means for supporting piston/displacer for use in a cryogenic refrigerator, characterized by lower local stresses and reduced susceptibility to fatigue failure so as to increase the service life of the overall cryogenic refrigerator.

A cryogenic refrigerator comprises a compressor and a cold finger connected to tile compressor. The compressor Includes a housing, a cylinder mounted within the housing, a piston reciprocal with a small clearance within the cylinder, and a compression chamber defined in the cylinder and having a variable volume. The cold finger includes a low temperature cylinder, a displacer reciprocal within the low temperature cylinder and adapted to divide the interior of the low temperature cylinder into a low temperature chamber and a high temperature chamber, a regenerator mounted within the displacer, and a spring chamber located below the low temperature cylinder.

According to one aspect of the invention, means are provided to support the piston and includes a plurality of flat piston suspension springs. The piston suspension springs have a plurality of spiral slits to provide a plurality of spiral arms deflectable as the piston is reciprocated within the compressor cylinder.

In a preferred embodiment, a plurality of annular inner retainers are secured to the piston and adapted to sandwich the Inner peripheral edges of the piston suspension springs. A plurality of annular outer retainers are secured to the compressor housing. The outer retainers include a plurality of projections extending inwardly from the outer ends of the spiral slits to sandwich the outer ends of the spiral arms in the piston suspension springs. The projections of each outer retainer have one sides to make a linear contact with the outer ends of the spiral arms to reduce the local stress intensity at the outer ends of the spiral arms when the spiral arms are periodically deflected.

In another preferred embodiment, a plurality of annular outer retainers are secured to the compressor housing and adapted to sandwich the outer peripheral edges of the piston suspension springs. A plurality of annular inner retainers are secured to the piston and include a plurality of projections extending outwardly from the inner ends of the spiral slits to sandwich the inner ends of the spiral arms in the piston suspension springs. The projections of each inner retainer have one sides to make a linear contact with the inner ends of the spiral arms to reduce the local stress intensity at the inner ends of the spiral arms when the spiral arms are periodically deflected.

Alternatively, each of the piston suspension springs has a plurality of spiral slits to provide a plurality of spiral arms. Each piston suspension spring also includes a plurality of apertures. The inner and/or outer ends of each spiral slit extend tangentially of and terminate at the apertures. The apertures are located between the inner and/or outer ends of each spiral slit and the inner and/or outer retainers. This arrangement is intended to reduce high stress concentration at the opposite ends of the spiral arms when the spiral arms are periodically deflected.

According to another aspect of the invention, means are provided to support the displacer and includes a plurality of flat displacer suspension springs. The flat displacer suspension springs have a plurality of spiral slits to provide a plurality of spiral arms deflectable as the displacer is reciprocated within the low temperature cylinder.

In a preferred embodiment, a plurality of flat displacer suspension springs have a plurality of spiral slits to provide a plurality of spiral arms deflectable as the displacer is reciprocated within the low temperature cylinder. A plurality of annular inner retainers are secured to the displacer and adapted to sandwich the inner peripheral edges of the displacer suspension springs. A plurality of annular outer retainers are secured to the spring chamber. The annular outer retainers include a plurality of projections extending inwardly from the outer ends of the spiral slits to sandwich the outer ends of the spiral arms in the displacer suspension springs. The projections of each outer retainer have one sides to make a linear contact with the spiral arms to reduce the local stress intensity at the outer ends of the spiral arms when the spiral arms are periodically deflected.

In another preferred embodiment, a plurality of flat displacer suspension springs include a plurality of spiral slits to provide a plurality of spiral arms deflectable as the displacer is reciprocated within the low temperature cylinder. A plurality of annular outer retainers are secured to the low temperature cylinder and adapted to sandwich the outer peripheral edges of the displacer suspension springs. A plurality of annular inner retainers are secured to the displacer. The annular inner retainers include a plurality of projections extending outwardly from the inner ends of the spiral slits to sandwich the inner ends of the spiral arms in the flat displacer suspension springs. The projections of each inner retainer have one sides to make a linear contact with the inner ends of the spiral arms when the spiral arms are periodically deflected.

Alternatively, each of the displacer suspension springs has a plurality of spiral slits to provide a plurality of spiral arms. Each displacer suspension spring also includes a plurality of apertures. The inner and/or outer ends of each spiral slit extend tangentially of and terminate at the apertures. The apertures are located between the inner and/or outer ends of each spiral slit and the inner and/or outer retainers. This arrangement is intended to reduce high stress concentration at the opposite ends of the spiral arms when the spiral arms are periodically deflected.

These and other objects and features of the present invention will become more clear from the following detailed description of preferred embodiments of the invention when taken in conjunction with the accompanying drawings.

DESCRIPTION OF THE PREFERRED EMBODIMENTS

Figure 1:
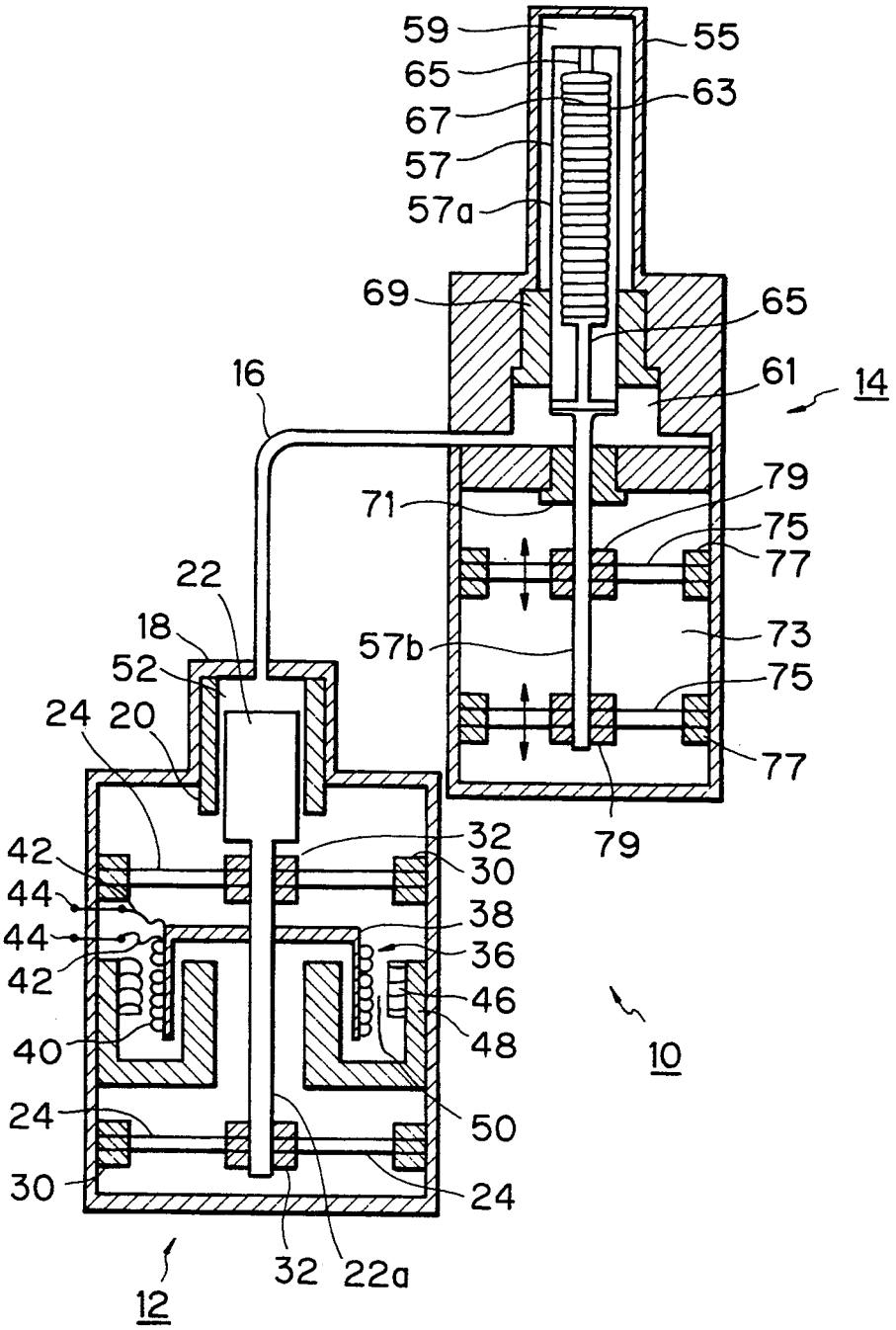
FIG. 1 is a side elevational view, in section, of a stirling refrigerator.

Like reference numerals designate like or corresponding parts throughout several views of the drawing.

Referring now to FIG. 1, a stirling refrigerator 10 generally comprises a compressor 12, and a cold finger 14 connected to the compressor 12 through a conduit 16. The compressor 12 includes a compressor housing 18 within which a vertical cylinder 20 is mounted, and a piston 22 mounted for reciprocal motion with a small clearance within the cylinder 20. A plurality of flat piston suspension springs 24 are arranged within the compressor housing 18 to support the piston 22 so as to prevent rubbing contact of the piston 22 with the inner wall of the cylinder 20 and thus, wear of the piston 22 and the cylinder 20.

Figure 2:
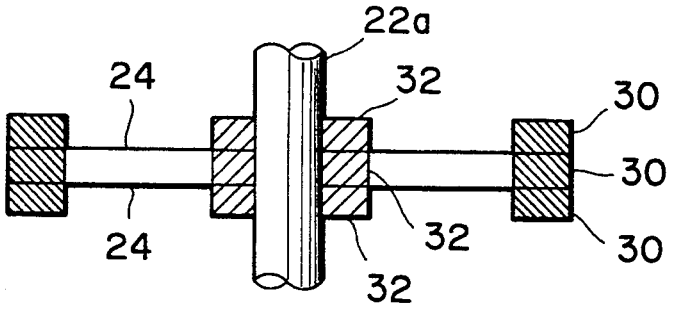
FIG. 2 is an enlarged view of means for supporting a piston, made according to a first embodiment of the present invention.
Figure 8:
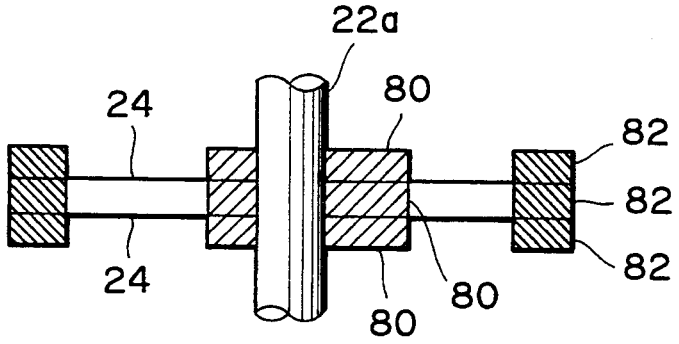
FIG. 8 is an enlarged view of means for supporting a piston, made according a third embodiment of the present invention.

As better shown in FIGS. 2 and 8, each of the piston suspension springs 24 is in the form of a circular disk and includes one or more spiral slits 24*a* to provide spiral arms 24*b*. The spiral arms 24*b* are vertically deflected as the piston 22 is reciprocated within the cylinder 20. A plurality of annular outer retainers 30 are secured to the inner wall of the housing 18 and arranged to sandwich the outer peripheral edges of the piston suspension springs 24. Similarly, a plurality of annular inner retainers 30 are secured to a piston rod 22*a* and arranged to sandwich the inner peripheral edges of the piston suspension springs 24.

Referring again to FIG. 1, a moving coil 36 is mounted to the piston rod 22*a* and includes a cylindrical bobbin 38 made from a non-magnetic material, and an electrically conductive wire 40 wound around the bobbin 38. A pair of lead wires 42 and 42 have one ends connected to ends of the electrically conductive wire 40 and the other ends connected to a corresponding pair of terminals 44 and 44. A permanent magnet 46 and a yoke 48 are mounted within the housing 18 and Jointly form a magnetic circuit. The magnetic circuit has a space 50 within which the moving coil 36 is free to reciprocate in the axial direction of the piston 22. A permanent magnetic field is formed horizontally within the space 50. A high pressure working gas such as helium gas is filled in the interior of the compressor 12. A compression chamber 52 is defined above the piston 22 within the cylinder 20. The piston 22 and the cylinder 20 are arranged to form as small an annular clearance as possible to substantially prevent the passing of working gas between the piston 22 and the cylinder 20.

The cold finger 14 includes a low temperature cylinder 55 within which a displacer 57 is reciprocally moved. The displacer 57 has a body 57*a* and a rod 57*b* extending downwardly from the body 57*a*. The interior of the low temperature cylinder 55 is divided by the displacer 57 into two chambers, namely, a low temperature chamber 59 above the displacer 57, and a high temperature chamber 61 below the displacer body 57*a*. A regenerator 63 is mounted within the displacer body 57*a*. A gas port 65 is formed in the displacer body 57*a* to provide a fluid communication between the lower temperature chamber 59 and the high temperature chamber 61 via the regenerator 63. The regenerator 63 is filled with regenerative material such as gauze disks 67 made of copper. A first sleeve 69 is fixed within the lower part of the low temperature cylinder 55 to surround part of the displacer body 57*a*. A second sleeve 71 is fixed below the high temperature chamber 61. The displacer rod 57*b* extends through the second sleeve 71 and into a spring chamber 73.

A high pressure working gas such as helium gas as in the compressor 12 is filled in the various chambers of the cold finger 14. The displacer body 57*a* and the first sleeve 69 are arranged to form as small an annular clearance as possible to substantially prevent the passing of working gas between the displacer body 57*a* and the first sleeve 69. Similarly, the displacer rod 57*b* and the second sleeve 71 are arranged to form as small an annular clearance as possible to substantially prevent the passing of working gas between the displacer rod 57*b* and the second sleeve 71. A plurality of flat displacer suspension springs 75 are mounted within the spring chamber 73 to support the displacer 57 so as to prevent rubbing contact of the displacer 57 with the first sleeve 69 and the second sleeve 71 and thus, wear of the displacer 57 and the sleeves 69 and 71 as the displacer 57 is reciprocated through the first sleeve 89 and the second sleeve 71.

Figure 5:
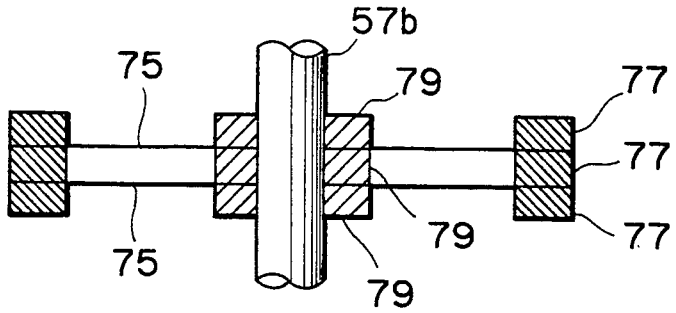
FIG. 5 is an enlarged view of means for supporting a displacer, made according to a second embodiment or the present invention.
Figure 6:
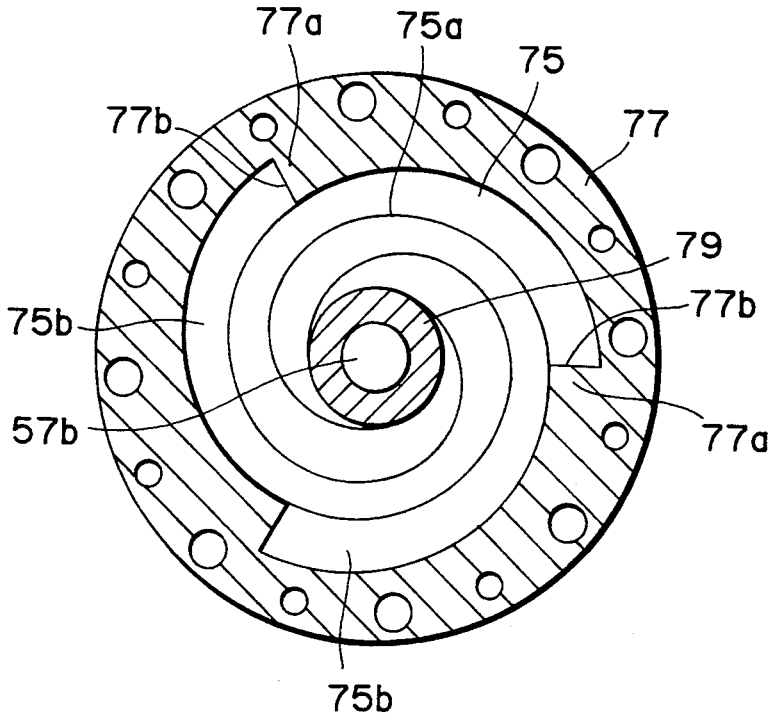
FIG. 6 is a plan view of FIG. 5, showing one form of outer retainers (only one is shown) between which displacer suspension springs are inserted.

As better shown in FIGS. 5 and 6, each of the displacer suspension springs 78 is in the form of a circular disk and has a plurality of spiral slits 75*a* to provide spiral arms 75*b*. The spiral arms 75*b* are vertically deflected as the displacer 57 is reciprocated. A plurality of annular outer retainers 77 are secured to the inner wall of the spring chamber 73 to sandwich the outer peripheral edges of the displacer suspension springs 75. Similarly, a plurality of annular inner retainers 79 are secured to the displacer rod 57*b* to sandwich the inner peripheral edges of the displacer suspension springs 75.

The compression chamber 52 of the compressor 12 is connected through the conduit 16 to the high temperature chamber 61 of the cold finger 14. The compression chamber 52, the conduit 16, the low temperature chamber 59, the high temperature chamber 61, the regenerator 57, and the gas port 65 are all communicated with one another and jointly form a working chamber.

In operation, an alternating current is applied to the electrically conductive wire 40 through the terminal 44 and the lead wire 42. This develops Lorentz's force in the axial direction of the electrically conductive wire 40 of the moving coil 36 as a result of interaction between the alternating current and the magnetic field in the space 50. The piston 22 is then oscillated or reciprocated within the compressor cylinder 20 under the action of the piston suspension springs 24 to cause sinusoidal oscillation of pressure of gas In the working chamber from the compression chamber 52 to the low temperature chamber 59.

The second sleeve 71 and the displacer rod 57*b* is arranged to enable the dimension of annular clearance to be so small that an effective clearance seal can be set up. However, such an clearance seal may be lost after the piston is operated over a period of time. This causes pressure in the spring chamber 73 to be kept approximately at an intermediate level between the maximum and minimum pulsating outputs of the piston 22.

When the pulsating output from the piston 22 is transmitted to the high temperature chamber 61, vertical load is exerted on the displacer 57. The load is represented by the difference between the pressures in the high temperature chamber 61 and the spring chamber 73 multiplied by the cross sectional area of the displacer rod 57*b*. Under this load as well as action of the displacer suspension springs 75, the displacer 57 is vertically oscillated within the cold finger 14 at the same frequency, but 90 degrees out of phase from the piston 22.

When the displacer 57 is positioned within the upper part of the cold finger 14, the piston 22 is moved up to compress a working gas in the overall working chamber. A working gas in the compression chamber 52 then flows through the conduit 16 to the high temperature chamber 61. The heat as generated when the working gas is compressed is dissipated to the atmosphere through the housing 18 and the conduit 16. The displacer 57 is then moved down to cause the working gas within the high temperature chamber 61 to flow through the regenerator 63 and the gas port 65 to the low temperature chamber 59. At this time, the working gas is cooled in the regenerator 63. The piston 22 is thereafter moved down to expand the working gas in the overall working chamber. The working gas in the low temperature chamber 59 is also expanded. This results in a decrease in the temperature of the working gas in the low temperature chamber 59. The displacer 57 is next moved up to cause the working gas in the low temperature chamber 59 to flow through the regenerator 63 and the gas port 65 to the high temperature chamber 61. At this time, the regenerator 63 is cooled. The piston 22 is again moved up to compress the working gas. The same cycle of operation is then repeated. The working gas generates heat when it is compressed upon upward motion of the piston 22 and absorbs heat from outside when it is expanded upon downward motion of the piston 22. As explained above, the working gas is: expanded when the displacer 57 is positioned within the upper part of the cold finger 14 or when the volume of the low temperature chamber 59 is small. Conversely, the working gas is expanded when the displacer 57 is positioned within the lower part of the cold finger 14 or when the volume of the low temperature chamber 59 is large. Thus, the low temperature chamber 59 is mainly subjected to gas expansion during each cycle of operation and absorb heat from one end of the cold finger to cool an object.

Figure 3:
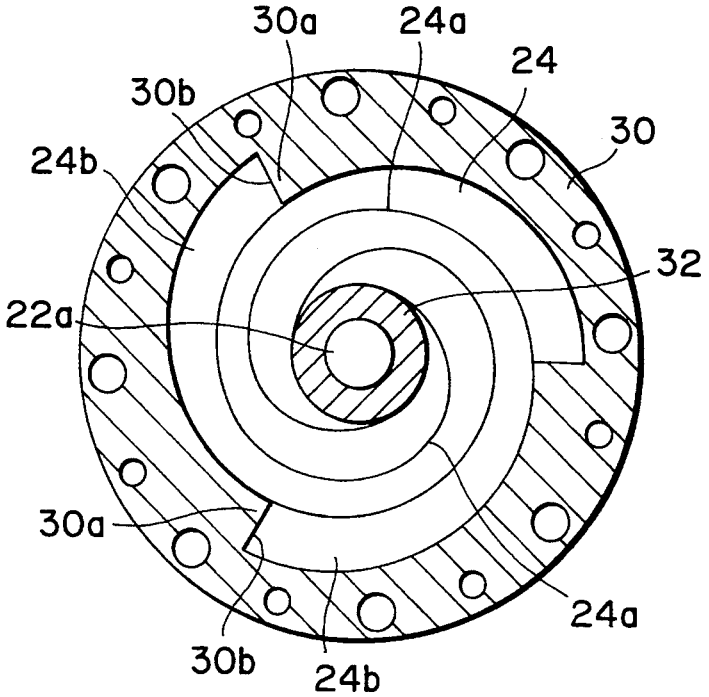
FIG. 3 is a plan view of FIG. 2, showing one form of outer retainers (only one is shown) between which piston suspension springs are inserted.
Figure 4:
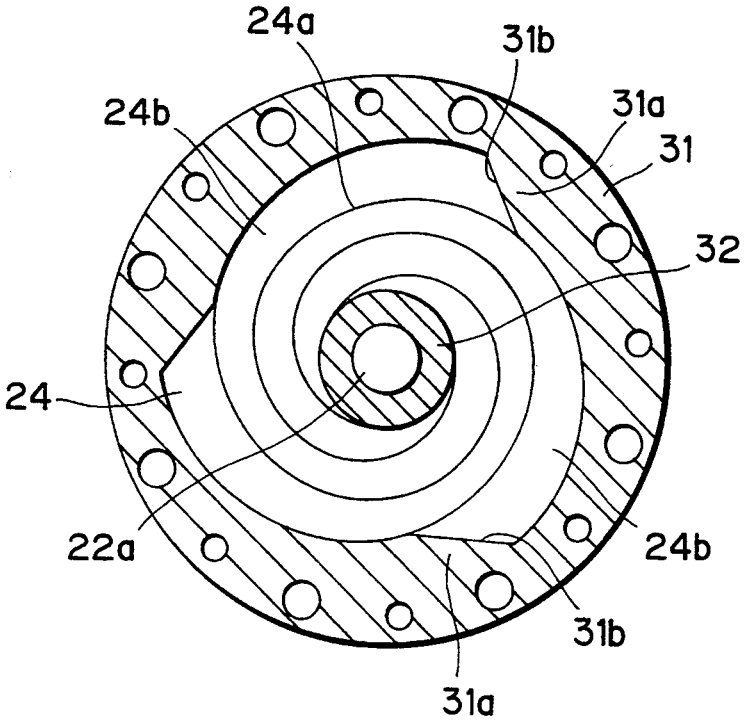
FIG. 4 is a view similar to FIG. 3, but showing a modified form of the outer retainers (only one is shown)

Referring again to FIG. 3, each of the annular outer retainers 30 includes a plurality of projections 30*a*. The projections 30*a* extend inwardly from the outer ends of the spiral slits 24*a* so as to sandwich the outer ends of the spiral arms 24*b* of the piston suspension spring 24. Each of the projections 30*a* has one side 30*b* extending radially of the piston suspension spring 24 to make a linear contact with the corresponding spiral arm 24*b*. This arrangement, linear contact rather than point contact as in the prior art, reduces the local stress intensity at the outer ends of the spiral arms 24*b* when the spiral arms 24*b* are periodically deflected. Alternatively, an annular outer retainer 31 may have projections 31*a* extending inwardly from the outer ends of the spiral slits 24*a* to sandwich the outer ends of the spiral arms 24*b*, and each of the projections may extend obliquely to the radial direction of the piston suspension spring 24 as shown in FIG. 4.

Figure 7:
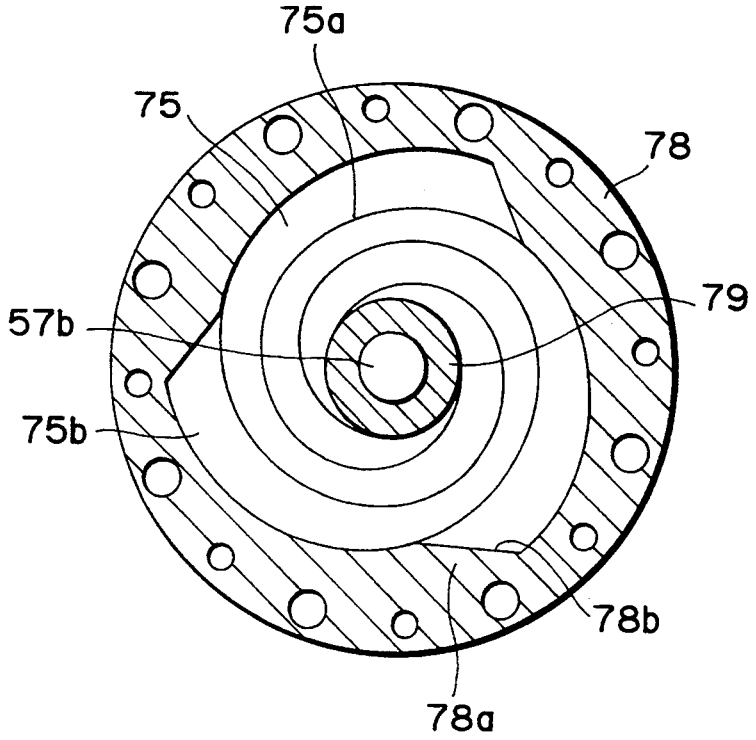
FIG. 7 is a view similar to FIG. 6, but showing a modified form of the outer retainers (only one is shown)

Referring to FIG. 6, each of the annular outer retainers 77 includes a plurality of projections 77*a*. The projections 77*a* extend inwardly from the outer ends of the spiral slits 75*a* so as to sandwich the outer ends of the spiral arms 75*b* of the displacer suspension spring 75. Each of the projections 77*a* has one side 77*b* extending radially of the displacer suspension spring 75 to make a linear contact with the corresponding spiral arm 75*b*. This arrangement, linear contact rather than point contact as in the prior art, reduces the local stress intensity at the outer ends of the spiral arms 75*b* when the spiral arms 75*b* are periodically deflected. Alternatively, an annular outer retainer 78 may have projections 78*a* extending inwardly from the outer ends of the spiral slits 75*a* to sandwich the outer ends of the spiral arms 75*b*, and each of the projections 78*a* may extend obliquely to the radial direction of the displacer suspension spring 75 as shown in FIG. 7.

Figure 9:
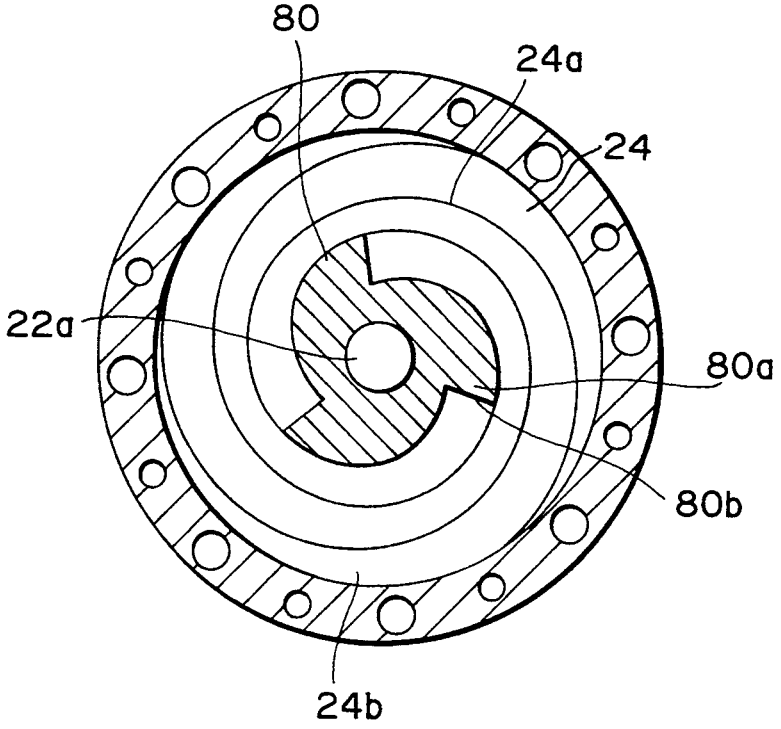
FIG. 9 is a plan view of FIG. 8, showing one form of inner retainers (only one is shown) between which piston suspension springs are inserted.
Figure 10:
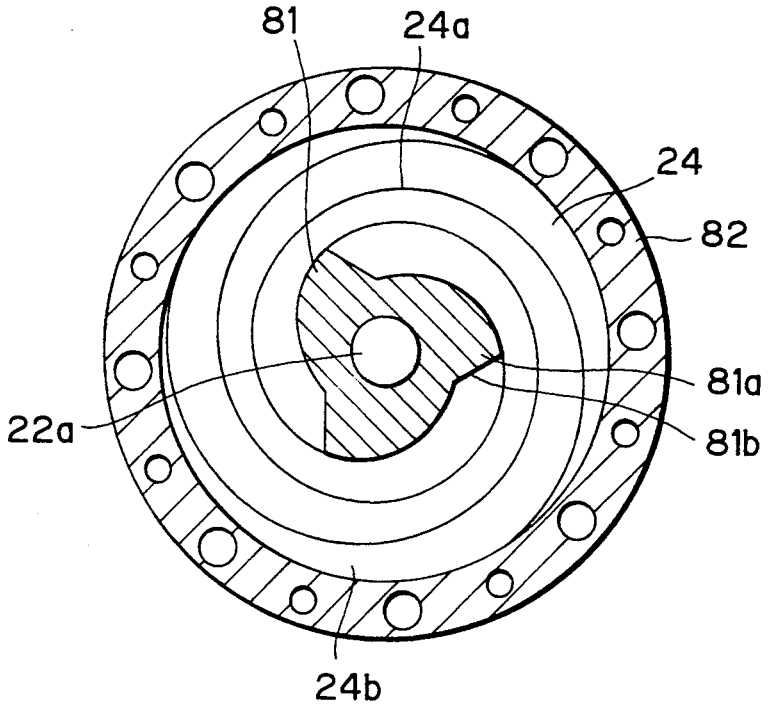
FIG. 10 is a view similar to FIG. 9, but showing a modified form of the inner retainers (only one is shown)
Figure 11:
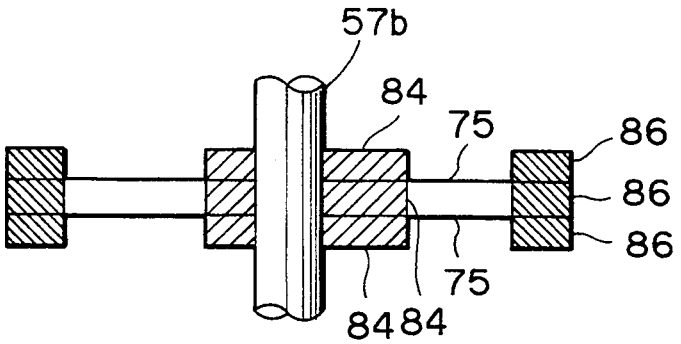
FIG. 11 is an enlarged view of means for supporting a displacer, made according a fourth embodiment of the present invention.

Referring to FIG. 9, each of the annular inner retainers 80 includes a plurality of projections 80*a*. The projections 80*a* extend outwardly from the inner ends of the spiral slits 24*a* so as to sandwich the inner ends of the spiral arms 24*b* of each piston suspension spring 24. Each of the projections 80*a* has one side 80*b* extending radially of the piston suspension spring 24 to make a linear contact with the corresponding spiral arm 24*b*. This arrangement, linear contact rather than point contact as in the prior art, reduces the local stress intensity at the inner ends of the spiral arms 24*b* when the spiral arms 24*b* are periodically deflected. Alternatively, an annular inner retainer 81 may have projections 81*a* extending outwardly from the inner ends of the spiral slits 24*a* to sandwich the inner ends of the spiral arms 24*b*, and each of the projections 81*a* may extend obliquely to the radial direction of the piston suspension spring 24.

Figure 12:
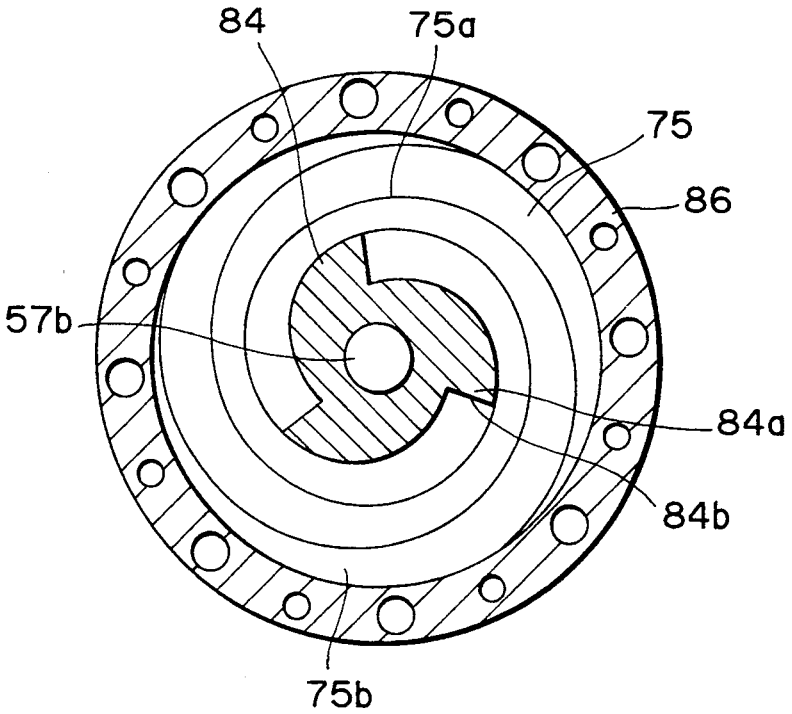
FIG. 12 is a plan view of FIG. 11, showing one form of inner retainers (only one is shown) between which displacer suspension springs are inserted.
Figure 13:
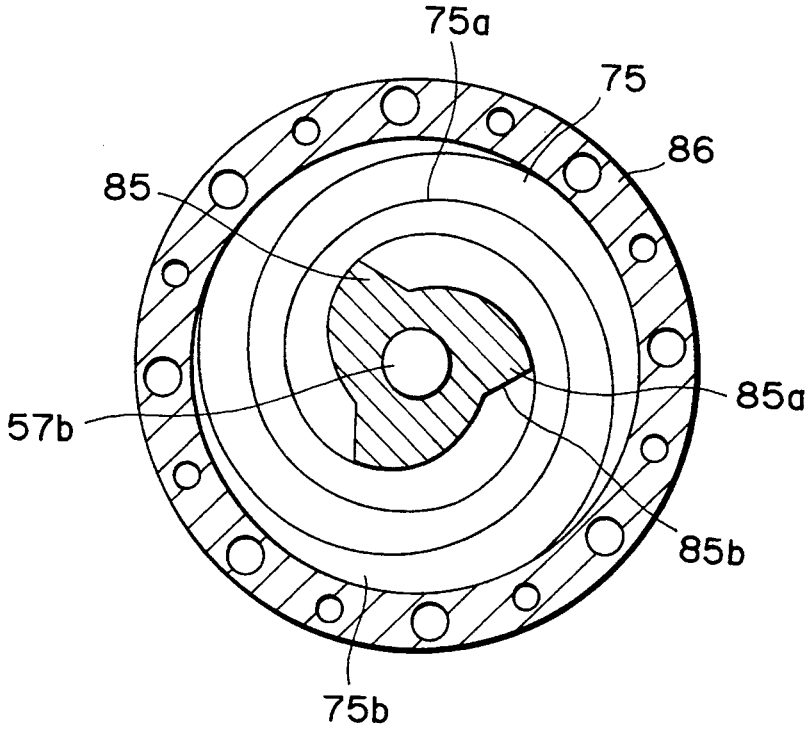
FIG. 13 is a view similar to FIG. 12, but showing a modified form of the inner retainers (only one is shown)

Referring to FIG. 12, each of the annular inner retainers 84 includes a plurality of projections 84*a*. The projections 84*a* extend outwardly from the inner ends of the spiral slits 75*a* so as to sandwich the inner ends of the spiral arms 75*b* of the displacer suspension spring 75. Each of the projections 84*a* has one side 84*b* extending radially of the displacer suspension spring 75 to make a linear contact with the corresponding spiral arm 75*b*. This arrangement, linear contact rather than point contact as in the prior art, reduces the local stress intensity at the inner ends of the spiral arms 75*b* when the spiral arms 75*b* are periodically deflected. Alternatively, an annular inner retainer 85 may have projections 85*a* extending outwardly from the inner ends of the spiral slits 75*a* to sandwich the inner ends of the spiral arms 75*b*, and each of the projections 85*a* may extend obliquely to the radial direction of the displacer suspension spring 75.

Figure 14:
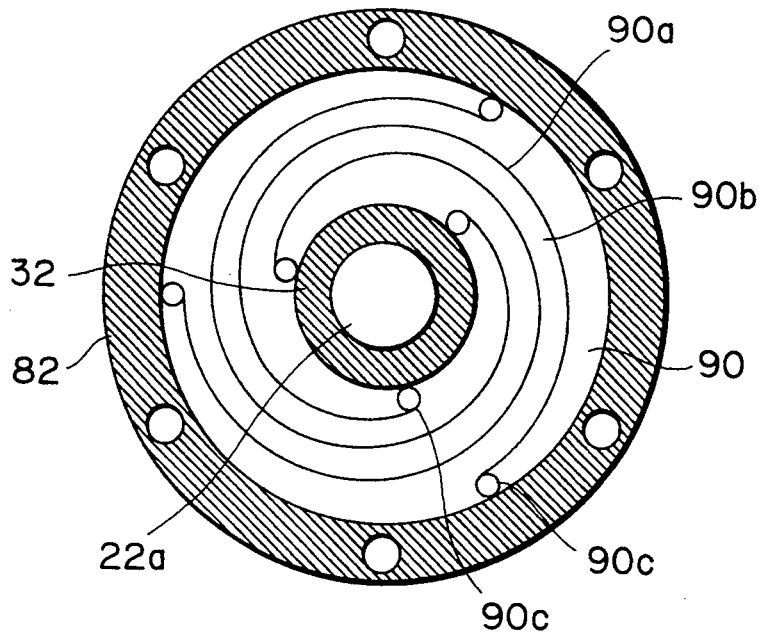
FIG. 14 is a plan view of means for supporting a piston, made according to a fifth embodiment of the present invention.

Referring to FIG. 14, a piston suspension spring 90 has a plurality of spiral slits 90*a* to provide a plurality of spiral arms 90*b*. In this embodiment, the piston suspension spring 90 includes a plurality of apertures 90*c*. The inner and outer ends of the spiral slits 90*a* extend tangentially of and terminate at the corresponding apertures 90*c*. The apertures 90*c* are located between the inner and outer ends of the spiral slits 90*a* and the inner and outer retainers 32 and 82, respectively. This arrangement is intended to reduce the local stress intensity at the inner and outer ends of the spiral arms 90*b* by distributing stresses along the apertures 90*c* when the spiral arms 90*b* are periodically deflected.

Figure 15:
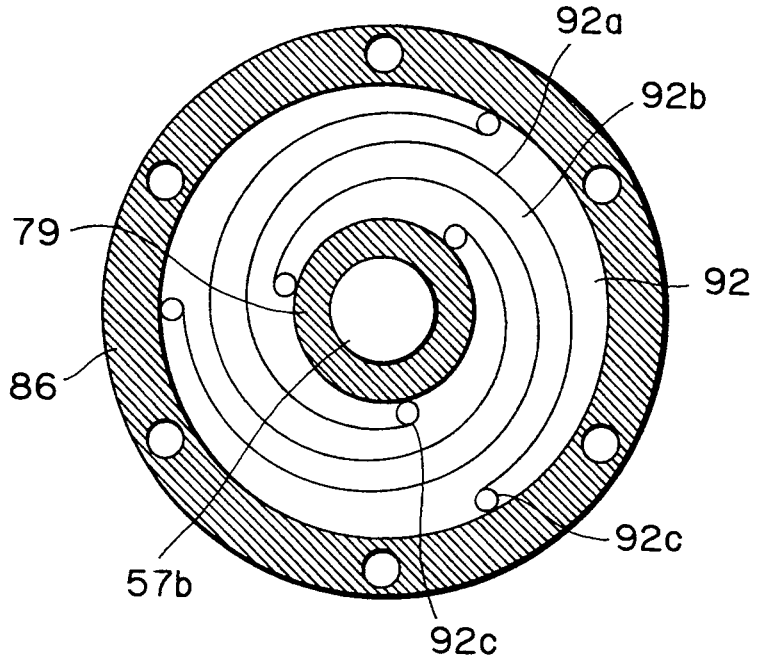
FIG. 15 is a plan view of means for supporting a displacer, made according to a sixth embodiment of the present invention.
Figure 16:
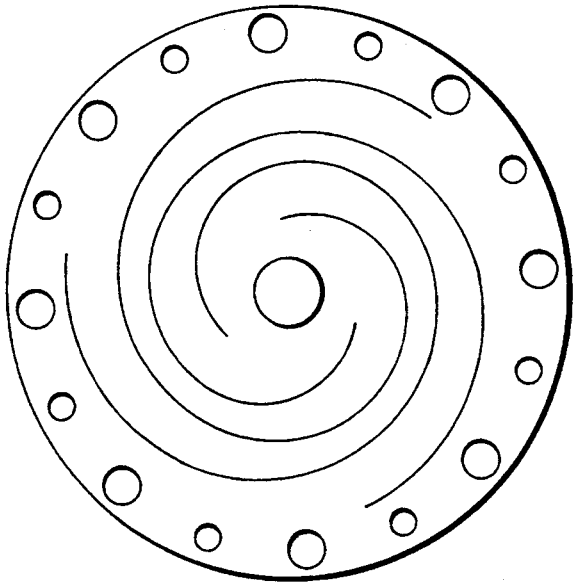
Fig. 16 PRIOR ART
FIG. 16 is a plan view of a piston suspension spring known in the art.
Figure 17:
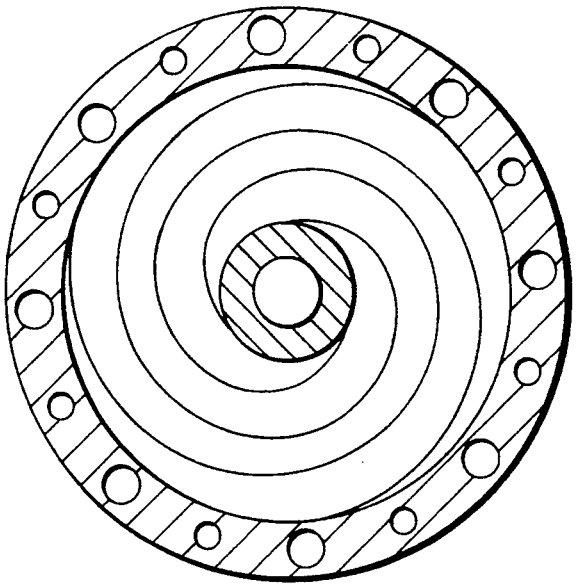
Fig. 17 PRIOR ART
FIG. 17 is a plan view of the piston suspension spring of FIG. 16 cooperating with inner and outer retainers to support a piston.
Figure 18:
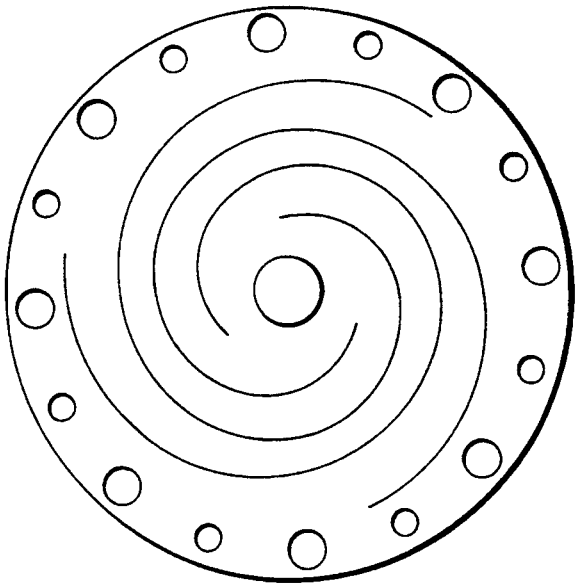
Fig. 18 PRIOR ART
FIG. 18 is a plan view of a displacer suspension spring known in the art.
Figure 19:
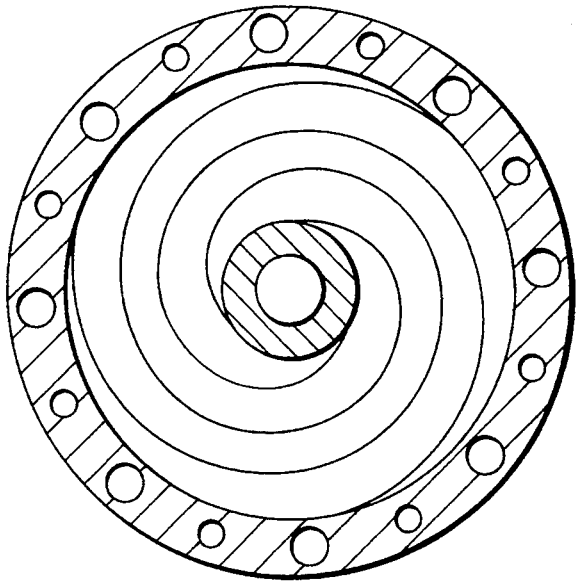
Fig. 19 PRIOR ART
FIG. 19 is a plan view of the displacer suspension spring of FIG. 18 cooperating with inner and outer retainers to support a displacer.

Referring to FIG. 15, a displacer suspension spring 92 has a plurality of spiral slits 92*a* to provide a plurality of the spiral arms 92*b*. In the illustrated embodiment, the displacer suspension spring 92 includes a plurality of apertures 92*c*. The inner and outer ends of the spiral slits 92*a* extend tangentially of and terminate at the corresponding apertures 92*c*. The apertures 92*c* are located between the inner and outer ends of the spiral slits and the inner and outer retainers 79 and 86, respectively. This arrangement is also intended to reduce the local stress intensity at the inner and outer ends of the spiral arms 92*b* by distributing stresses along the apertures 92*c* when the spiral arms 92*b* are periodically deflected.

Although preferred embodiments of the invention have been described in detail, it will be understood that various changes and modifications may be made without departing from the claimed scope of the invention.

What is claimed is:

1. In a cryogenic refrigerator comprising a compressor including a compressor housing, a cylinder mounted within said housing, a piston reciprocable within said cylinder, and a compression chamber defined in said cylinder and having a variable volume, and a cold finger including a low temperature cylinder, a displacer reciprocable within said low temperature cylinder into a low temperature chamber and a high temperature chamber, and a regenerator mounted within said displacer, the improvements comprising means for supporting said piston, said means including:

at least one flat piston suspension spring having a top and bottom surface and having inner and outer peripheral edges, said at least one flat piston suspension spring including a plurality of spiral slits to provide a plurality of spiral arms deflectable as said piston is reciprocated within said compressor cylinder, each of said plurality of spiral slits having inner and outer ends;

a plurality of annular inner retainers secured to said piston and adapted to sandwich the inner peripheral edge of said at least one piston suspension spring; and a plurality of annular outer retainers secured to said compressor housing, said plurality of annular outer retainers including a plurality of projections which extend inwardly and overlay and contact both surfaces of the outer ends of the spiral arms to sandwich the outer ends of said spiral arms in said at least one flat piston suspension spring.

2. The invention of claim 1, wherein each of said plurality of projections has one side extending radially of said at least one flat piston suspension spring.

3. The invention of claim 1, wherein each of said plurality of projections has one side extending obliquely to the radial direction of said at least one flat piston suspension spring.

4. In a cryogenic refrigerator comprising a compressor including a compressor housing, a cylinder mounted within said housing, a piston reciprocable within said cylinder, and a compression chamber defined in said cylinder and having a variable volume, and a cold finger including a low temperature cylinder, a displacer reciprocable within said low temperature cylinder and adapted to divide the interior of said low temperature cylinder into a low temperature chamber and a high temperature chamber, and a regenerator mounted within said displacer, the improvements comprising means for supporting said piston, said means including:

at least one flat piston suspension spring having a top and bottom surface and inner and outer peripheral edges, said at least one flat piston suspension spring including a plurality of spiral slits to provide a plurality of spiral arms deflectable as said piston is reciprocated within said compressor cylinder, each of said plurality of spiral slits having inner and outer ends;

a plurality of annular outer retainers secured to said compressor housing and adapted to sandwich the outer peripheral edge of said at least one piston suspension spring; and a plurality of annular inner retainers secured to said piston, said plurality of annular inner retainers including a plurality of projections extending outwardly which overlay and contact both surfaces of the inner ends of the spiral arms to sandwich the inner ends of said spiral arms in said at least one flat piston suspension spring.

5. The invention of claim 4, wherein each of said plurality of projections has one side extending radially of said at least one flat piston suspension spring.

6. The invention of claim 4, wherein each of said plurality of projections has one side extending obliquely to the radial direction of said at least one flat piston suspension spring.

7. In a cryogenic refrigerator comprising a compressor including a compressor housing, a cylinder mounted within said housing, a piston reciprocable within said cylinder, and a compression chamber defined in said cylinder and having a variable volume, and a cold finger including a low temperature cylinder, a displacer reciprocable within said low temperature cylinder into a low temperature chamber and a high temperature chamber, a regenerator mounted within said displacer, and a spring chamber extending from said low temperature cylinder, the improvements comprising means for supporting said displacer, said means including:

at least one flat displacer suspension spring having inner and outer peripheral edges, said at least one flat displacer suspension spring including a plurality of spiral slits to provide a plurality of spiral arms deflectable as said displacer is reciprocated within said low temperature cylinder, each of said plurality of spiral slits having inner and outer ends;

a plurality of annular inner retainers secured to said displacer and adapted to sandwich the inner peripheral edge of said at least one displacer suspension spring; and a plurality of annular outer retainers secured to said spring chamber, said plurality of annular outer retainers including a plurality of projections extending inwardly which overlay the outer ends of the spiral arms to sandwich outer ends of said spiral arms in said at least one flat displacer suspension spring.

8. The invention of claim 7, wherein each of said plurality of projections has one side extending radially of said at least one flat piston suspension spring.

9. The invention of claim 7, wherein each of said plurality of projections has one side extending obliquely to the radial direction of said at least one flat piston suspension spring.

10. In a cryogenic refrigerator comprising a compressor including a compressor housing, a cylinder mounted within said housing, a piston reciprocable within said cylinder, and a compression chamber defined in said cylinder and having a variable volume, and a cold finger including a low temperature cylinder, a displacer reciprocable within said low temperature cylinder and adapted to divide the interior of said low temperature cylinder into a low temperature chamber and a high temperature chamber, a regenerator mounted within said displacer, and a spring chamber extending from said low temperature cylinder, the improvements comprising means for supporting said displacer, said means including:

at least one flat displacer suspension spring having inner and outer peripheral edges, said at least one flat displacer suspension spring including a plurality of spiral slits to provide a plurality of spiral arms deflectable as said displacer is reciprocated within said low temperature cylinder, each of said plurality of spiral slits having inner and outer ends;

a plurality of annular outer retainers secured to said low temperature cylinder and adapted to sandwich the outer peripheral edge of said at least one displacer suspension spring; and a plurality of annular inner retainers secured to said displacer, said plurality of annular inner retainers including a plurality of projections extending outwardly which overlay the inner ends of the spiral arms to sandwich inner ends of said spiral arms in said at least one flat displacer suspension spring.

11. The invention of claim 10, wherein each of said plurality of projections has one side extending radially of said at least one flat piston suspension spring.

12. The invention of claim 10, wherein each of said plurality of projections has one side extending obliquely to the radial direction of said at least one flat piston suspension spring.

13. In a cryogenic refrigerator comprising a compressor including a compressor housing, a cylinder mounted within said housing, a piston reciprocable within said cylinder, and a compression chamber defined in said cylinder and having a variable volume, and a cold finger including a low temperature cylinder, a displacer reciprocable within said low temperature cylinder and adapted to divide the interior of said low temperature cylinder into a low temperature chamber and a high temperature chamber, and a regenerator mounted within said displacer, the improvements comprising means for supporting said piston, said means including:

at least one flat piston suspension spring having inner and outer peripheral edges, said at least one flat piston suspension spring including a plurality of spiral slits to provide a plurality of spiral slits to provide a plurality of spiral arms deflectable as said piston is reciprocated within said compressor cylinder, each of said plurality of spiral arms having inner and outer ends;

a plurality of annular inner retainers secured to said piston and adapted to sandwich the inner peripheral edge of said at least one piston suspension spring;

a plurality of annular outer retainers secured to said compressor housing and adapted to sandwich the outer peripheral edge of said at least one flat piston suspension spring, said at least one flat piston suspension spring further including a plurality of apertures located at the inner ends of the spiral arms and tangential to the inner retainers and the spiral slits.

14. The invention of claim 13, wherein each of said apertures is substantially circular in shape.

15. In a cryogenic refrigerator comprising a compressor including a compressor housing, a cylinder mounted within said housing, a piston reciprocable within said cylinder, and a compression chamber defined in said cylinder and having a variable volume, and a cold finger including a low temperature cylinder, a displacer reciprocable within said low temperature cylinder and adapted to divide the interior of said low temperature cylinder into a low temperature chamber and a high temperature chamber, and a regenerator mounted within said displacer, the improvements comprising means for supporting said piston, said means including:

at least one flat piston suspension spring having inner and outer peripheral edges, said at least one flat piston suspension spring including a plurality of spiral slits to provide a plurality of spiral arms deflectable as said piston is reciprocated within said compressor cylinder, each of said plurality of spiral arms having inner and outer ends;

a plurality of annular inner retainers secured to said piston and adapted to sandwich the inner peripheral edge of said at least one piston suspension spring; and a plurality of annular outer retainers secured to said piston and adapted to sandwich the outer peripheral edge of said at least one piston suspension spring, said at least one flat piston suspension spring further including a plurality of apertures which are disposed at the outer ends of the spiral arms and tangentially to the outer retainers and the spiral slits.

16. The invention of claim 15, wherein each of said apertures is substantially circular in shape.

17. In a cryogenic refrigerator comprising a compressor including a compressor housing, a cylinder mounted within said housing, a piston reciprocable within said cylinder, and a compression chamber defined in said cylinder and having a variable volume, and a cold finger including a low temperature cylinder, a displacer reciprocable within said low temperature cylinder and adapted to divide the interior of said low temperature cylinder into a low temperature chamber and a high temperature chamber, and a regenerator mounted within said displacer, and a spring chamber extending from said low temperature cylinder, the improvements comprising means for supporting said displacer, said means including:

at least one flat displacer suspension spring having inner and outer peripheral edges, said at least one flat displacer suspension spring including a plurality of spiral slits to provide a plurality of spiral arms deflectable as said displacer is reciprocated within said low temperature cylinder, each of said plurality of spiral arms having inner and outer ends;

a plurality of annular inner retainers secured to said displacer and adapted to sandwich the inner peripheral edge of said at least one displacer suspension spring; and a plurality of annular outer retainers secured to said spring chamber and adapted to sandwich the outer peripheral edge of said at least one flat displacer suspension spring, said at least one flat displacer suspension spring further including a plurality of apertures disposed at the inner ends of the spiral arms and tangentially to the inner retainers and the spiral slits.

18. The invention of claim 17, wherein each of said apertures is substantially circular in shape.

19. In a cryogenic refrigerator comprising a compressor including a compressor housing, a cylinder mounted within said housing, a piston reciprocable within said cylinder, and a compression chamber defined in said cylinder and having a variable volume, and a cold finger including a low temperature cylinder, a displacer reciprocable within said low temperature cylinder and adapted to divide the interior of said low temperature cylinder into a low temperature chamber and a high temperature chamber, a regenerator mounted within said displacer, and a spring chamber extending from said low temperature cylinder, the improvements comprising means for supporting said displacer, said means including:

at least one flat displacer suspension spring having inner and outer peripheral edges, said at least one flat displacer suspension spring including a plurality of spiral slits to provide a plurality of spiral arms deflectable as said displacer is reciprocated within said low temperature cylinder, each of said plurality of spiral arms having inner and outer ends;

a plurality of annular inner retainers secured to said displacer and adapted to sandwich the inner peripheral edge of said at least one displacer suspension spring; and a plurality of annular outer retainers secured to said spring chamber and adapted to sandwich the outer peripheral edge of said at least one flat displacer suspension spring, said at least one flat displacer suspension spring further including a plurality of apertures located tangentially to the outer retainers and the spiral slits.

20. The invention of claim 19, wherein each of said apertures is substantially circular in shape.

21. A cryogenic refrigerator comprising:

a compressor including a compressor housing;

a cylinder mounted within the compressor housing;

a piston which reciprocates within the cylinder;

a substantially flat piston suspension spring having inner and outer peripheral edges, and including a plurality of spiral slits providing a plurality of spiral arms on said spring, each of said spiral arms including inner and outer ends corresponding respectively to the inner and outer peripheral edges of the spring;

at least one annular inner retainer secured to the piston and retaining the inner edge of the spring; and at least one annular outer retainer secured to the compressor housing and including a plurality of support projections which extend inwardly and contact a surface of outer ends of the spiral arms to retain the outer edge of the spring.

22. A cryogenic refrigerator comprising:

a compressor including a compressor housing;

a cylinder mounted within the compressor housing;

a piston which reciprocates within the cylinder;

a substantially flat piston suspension spring having inner and outer peripheral edges, and including a plurality of spiral slits providing a plurality of spiral arms on said spring, each of said spiral arms including inner and outer ends corresponding respectively to the inner and outer peripheral edges of the spring;

at least one annular outer retainer secured to the compressor housing and retaining the outer edge of the spring; and at least one annular inner retainer secured to the piston and including a plurality of support projections which extend outwardly and contact a surface of the inner ends of the spiral arms to retain the inner edge of the spring.

23. A cryogenic refrigerator comprising:

a compressor including a compressor housing;

a cylinder mounted within the compressor housing;

a piston which reciprocates within the cylinder;

a substantially flat piston suspension spring having inner and outer peripheral edges, and including a plurality of spiral slits providing a plurality of spiral arms on said spring, each of said spiral arms including inner and outer ends corresponding respectively to the inner and outer peripheral edges of the spring;

at least one annular inner retainer secured to the piston and retaining the inner edge of the spring; and at least one annular outer retainer secured to the compressor housing and retaining the outer edge of the spring;

wherein the spring includes a plurality of openings located tangential to the inner and outer retainers and at the ends of the spiral arms.

24. A cryogenic refrigerator comprising:

a compressor including a compressor housing;

a cylinder mounted within the compressor housing;

a piston which reciprocates within the cylinder;

a substantially flat piston suspension spring having inner and outer peripheral edges, and including a plurality of spiral slits providing a plurality of spiral arms on said spring, each of said spiral arms including inner and outer ends corresponding respectively to the inner and outer peripheral edges of the spring;

at least one annular inner retainer secured to the piston and retaining the inner edge of the spring; and at least one annular outer retainer secured to the compressor housing and retaining the outer edge of the spring;

wherein the spring includes a plurality of apertures disposed directly at the ends of the spiral arms and adjacent to the inner and outer retainers.

* * * * *